US006486852B1

(12) United States Patent
Hirose et al.

(10) Patent No.: US 6,486,852 B1
(45) Date of Patent: Nov. 26, 2002

(54) ANTENNA DEVICE AND ASSEMBLY OF THE ANTENNA DEVICE

(75) Inventors: Eiichiro Hirose; Akikazu Toyoda; Yoshiomi Go; Shinji Sakai; Hiroaki Tanidokoro; Naoto Kitahara, all of Chichibu-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/641,702

(22) Filed: Aug. 21, 2000

(30) Foreign Application Priority Data

Jan. 31, 2000 (JP) ..... 2000-027222

(51) Int. Cl.[7] ..... H01Q 1/24

(52) U.S. Cl. ..... 343/895; 343/700 MS; 343/702

(58) Field of Search ..... 343/700 MS, 702, 343/872, 873, 895

(56) References Cited

U.S. PATENT DOCUMENTS 5,764,198 A * 6/1998 Tsuru et al. ..... 343/895
5,977,927 A * 11/1999 Mandai et al. ..... 343/788
6,028,568 A * 2/2000 Asakura et al. ..... 343/895
6,064,351 A * 5/2000 Mandai et al. ..... 343/873
6,288,680 B1 * 9/2001 Tsuru et al. ..... 343/702

FOREIGN PATENT DOCUMENTS

| | | |
|---|---|---|
| JP | 04-137602 | 5/1992 |
| JP | 06-029714 | 2/1994 |
| JP | 09-036639 | 2/1997 |
| JP | 10-065426 | 3/1998 |
| JP | 10-084216 | 3/1998 |
| JP | 10-208942 | 8/1998 |

* cited by examiner

*Primary Examiner*—Tan Ho
(74) *Attorney, Agent, or Firm*—Oblon, Spivak, McClelland, Maier & Neustadt, P.C.

(57) ABSTRACT

The present invention relates to an antenna device to be used for portable communication sets and a method for reducing the manufacturing cost thereof. The antenna device includes a substrate having at least one of a dielectric material and a magnetic material and having upper and lower faces as well as a pair of side faces on which convex portions and concave portions are alternately formed. Also included is a helical conductor layer formed on the upper and lower faces, and on the concave portion or convex portion on a pair of the side faces of the substrate so as to spirally surround the entire substrate.

21 Claims, 13 Drawing Sheets

ANTENNA DEVICE AND ASSEMBLY OF THE ANTENNA DEVICE

CROSS-REFERENCE TO A RELATED APPLICATION

This application is related to Japanese Patent Application No. 2000-027222 filed on Jan. 31, 2000, the entire contents of which are incorporated by reference.

BACKGROUND OF THE INVENTION

1. Field of the Invention

The present invention relates to an antenna device to be used for portable communication sets.

2. Discussion of the Background

Although a linear antenna such as a pole antenna or a rod antenna has been used in communication sets (e.g., a portable phone), the linear antenna hinders the communication set from being small in size because the antenna is attached at an outside of the case of the communication set. The linear antenna is also likely to break, deform and deteriorate due to external mechanical forces applied to the linear antenna. In addition, the linear antenna is not preferable for reducing the packaging cost because a number of components are required to pack the antenna via coaxial cables and connectors.

For solving the problems described above, Japanese Unexamined Patent Application Publication No. 9-64627 proposes a compact antenna capable of surface-packaging on a circuit board as shown in FIG. 26. A helical antenna is formed within a ceramic substrate 30 by making use of a technique for forming a multi-layer ceramic substrate. A conductor line 31 is formed on each ceramic layer, and the conductor lines on different ceramic layers are connected to one another via through holes 32 in which a conductive material is filled to form a helical conductor as a whole. A ceramic antenna including the helical radiation conductor is assembled by laminating the ceramic layers. A terminal 33 for feeding electricity to the helical conductor is provided on the side face of the substrate 30.

However, because the laminated ceramic sheets are fired after a conductor line is formed on each ceramic sheet, the conductor line is designed by taking into consideration a shrinkage of the conductor line due to the firing process. A highly rigid process control is also required to restrict the shrinkage ratio within a prescribed range, thus making it difficult to reduce the production cost.

Even if all the conductor lines are formed on the surface of the already fired ceramic sheet, conductor patterns should nevertheless be formed on at least four faces of a ceramic block having flat surfaces by a method capable of fine control of the conductor pattern such as a printing method, also preventing the production cost from being reduced.

SUMMARY OF THE INVENTION

Accordingly, one object of the present invention is to solve the above and other noted problems.

Another object of the present invention is to provide an antenna device designed to reduce production costs.

To achieve these and other objects, the present invention provides an antenna device including a substrate having upper and lower faces, and a pair of side faces on which convex portions and concave portions are alternately formed. The antenna device also includes a helical conductor layer on the upper and lower faces, and on one of the concave portions and convex portions so as to spirally surround the entire substrate.

Preferably, at least one of the convex and concave portions on the side faces serves as a power feed electrode for feeding electricity to the helical conductor layer in the antenna device according to the present invention.

In addition, the antenna device according to the present invention preferably has a layer including at least one of the dielectric material and magnetic material covering at least a part of the helical conductor layer formed on the substrate.

Further, the antenna device according to the present invention includes a helical antenna in which a helical emission conductor is formed on the surface of the ceramic substrate, and the conductor layer on the upper and lower faces of the substrate can be formed by printing. Electrodes can be formed only on the convex portions by a high speed coating method such as a dip method or by using a roll coater for forming the conductive layer on the convex portions on the side face. Using the roll coater enables superior mass-productivity compared to the printing method to be attained for forming the electrode particularly on the convex portion. It is also an advantage of forming the electrode on the convex portion that solder hardly forms solder bridges when the solder is used for connecting the electrode on the convex portion in mounting the antenna device. When the conductive layer is formed in the concave portion on the side face, on the other hand, it can be formed by filling a conductor material in through holes to be described hereinafter, also offering an advantage that the solder bridge is hardly formed. Accordingly, the present invention can make mass-production easy and reduce production costs.

The surface mountable type antenna can also be readily manufactured since the side face convex portions and concave portions themselves on which conductor lines are formed can be utilized as terminal electrodes.

The side face convex portion or the side face concave portion itself may be utilized as a power feed electrode and an earth electrode as described above. Providing a dielectric layer or a magnetic layer so as to cover the helical conductor enables the antenna device to be more compact.

Resonance frequencies of the antenna may largely be distributed in the present invention when the conductor pattern is formed so that the power feed electrode is connected to the earth electrode on the lower face of the substrate making contact with the circuit substrate.

In addition, allowing the power feed electrode to be connected to the earth electrode on the upper face or on the side face can eliminate the drawbacks as described above to enable a highly precise antenna to be constructed.

The present invention also provides a method of making the antenna device.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
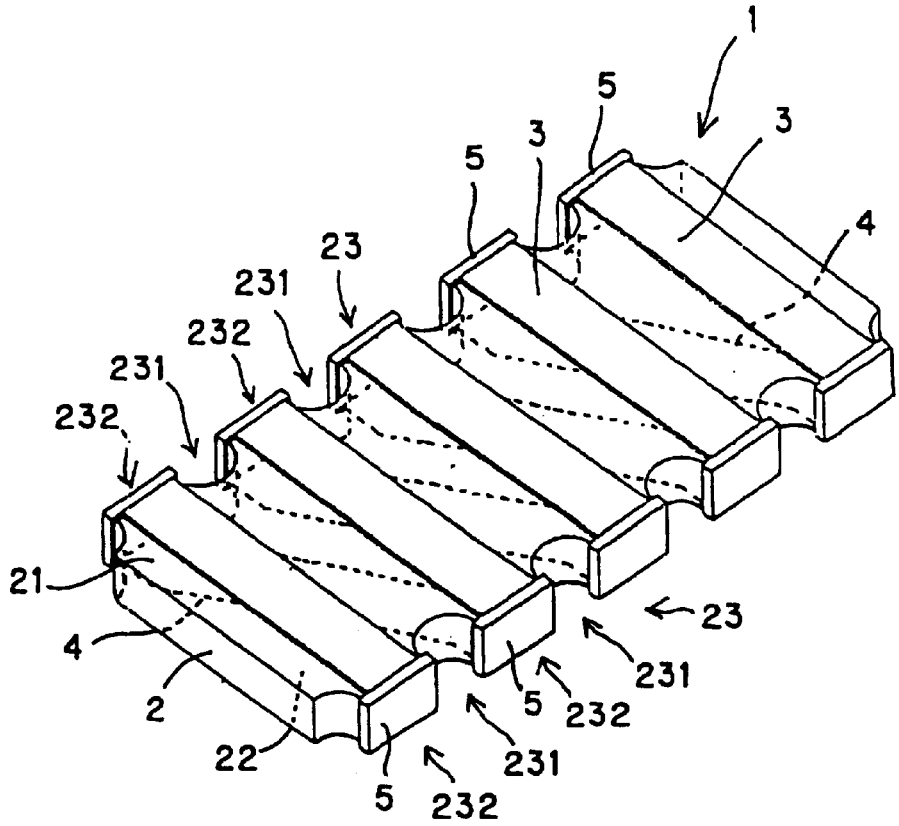
FIG. 1 shows a perspective view of the antenna device according to a first example of the present invention.

Referring now to the drawings, wherein like reference numerals designate identical or corresponding parts throughout the several views, the examples of the present invention will be described hereinafter. In particular, FIG. 1 shows a perspective view of the antenna device according to the first example of the present invention. As shown, a substrate 2 of an antenna device 1 includes an upper face 21 and a lower face 22, and a pair of side faces 23 on which concave portions 231 and convex portions 232 are alternately formed. Conductor layers 3 for connecting corresponding convex portions 232 on opposite side faces 23 are formed on the upper face 21 of the substrate 2. Conductor layers 4 are formed on the lower face 22 of the substrate 2. As shown, a conductor layer 4 connects a convex portion 232 on one side face 23 to another convex portion 232 on an opposite side face 23 and which is shifted by one pitch. Conductor layers 5 are also formed on the convex portions 232 on the side faces 23. The conductor layers 3, 4 and 5 serve as a helical conductor layer for surrounding the substrate 2 as a whole.

The preferable substrate 2 has a stable specific dielectric constant ($\epsilon r$) or a stable specific magnetic permeability ($\mu r$) with a low loss and a small temperature coefficient ($\tau r$) of a resonance frequency. An alumina based ceramic ($\in r$=8.5, Q=1000 and $\tau r$=38 ppm/° C. at 2 GHz) was used in this embodiment. The preferable conductor includes a low resistance conductor such as copper, silver and gold. A silver-platinum paste (QS-171 made by Dupont CO.) was used in this example.

Figure 2:
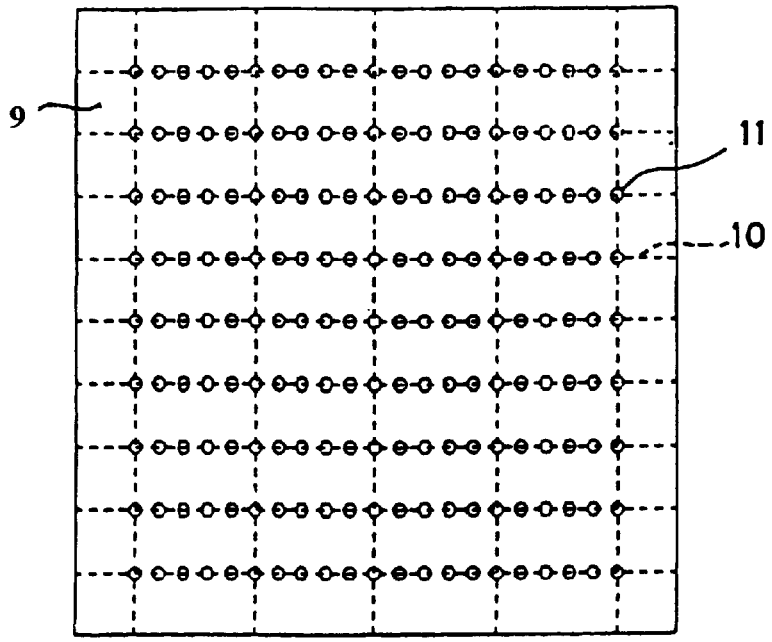
FIG. 2 shows an intermediate step of the manufacturing process of the antenna device shown in FIG. 1.
Figure 3:
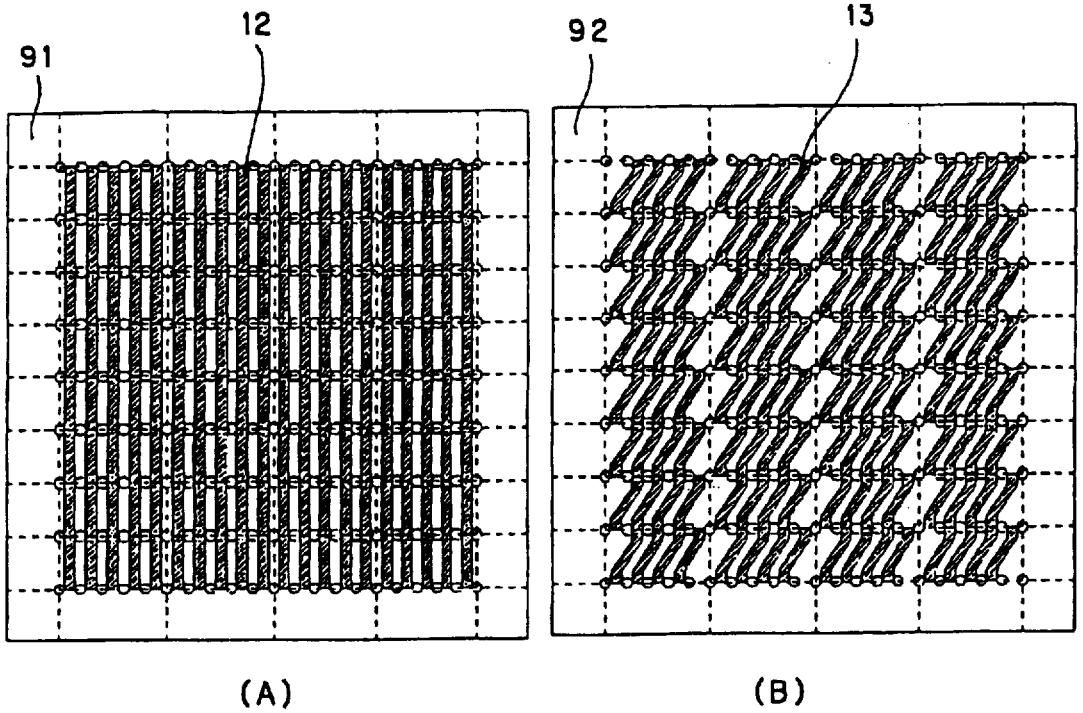
FIG. 3A shows another intermediate step of the manufacturing process of the antenna device shown in FIG. 1.
FIG. 3B shows yet another intermediate step of the manufacturing process of the antenna device shown in FIG. 1.

The method for manufacturing the antenna device 1 will now be described with reference to FIGS. 2 to 5. First an alumina substrate 9 shown in FIG. 2 is prepared. Snap lines 10 are provided on the alumina substrate 9 so as to be able to divide the substrate into a desired size in subsequent steps, and through holes 11 are provided at desired sites on the snap lines 10. The snap lines 10 are separated by a distance of 5 mm along the vertical direction and by a distance of 10 mm along the transverse direction. The through holes 11 have a diameter of 0.8 mm and are separated by a distance of 2 mm on the snap lines 10 along the transverse direction on the alumina substrate 9. The substrate 9 has a width of 50 mm, a length of 50 mm and a thickness of 1 mm.

Subsequently, as shown in FIGS. 3A and 3B, conductor patterns 12 and 13 are respectively formed on an upper face 91 and lower face 92 of the alumina substrate 9. The patterns may be formed by screen-printing a conductive paste and subjecting the pattern to firing at 850° C. after drying.

Figure 4:
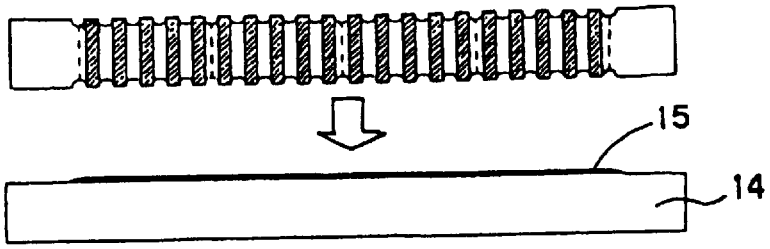
FIG. 4 shows still another intermediate step of the manufacturing process of the antenna device shown in FIG. 1.

The alumina substrate 9 is then divided along the snap lines on which through holes had been formed as shown in FIG. 4. Convex portions formed on the alumina substrate by the through holes are then dipped into a conductor paste 15 previously spread to a thickness of about 0.2 mm on a flat plate 14, such as a glass plate using a squeezer to coat only the tips of the convex portions with the conductor paste 15. The convex portions including the conductor paste 15 are then dried and fired.

Figure 5:
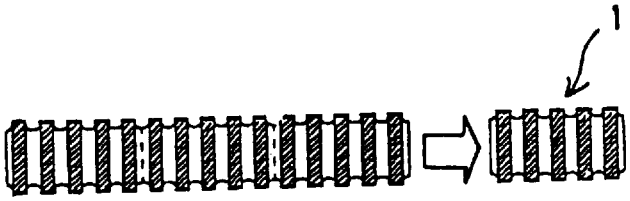
FIG. 5 shows another intermediate step of the manufacturing process of the antenna device shown in FIG. 1.

As shown in FIG. 5, an antenna device 1 is finally obtained by dividing the flat plate into minimum units along the snap lines. Several antennas having a construction as described above can be manufactured at the same time, thus reducing the costs of making the antennas.

Figure 6:
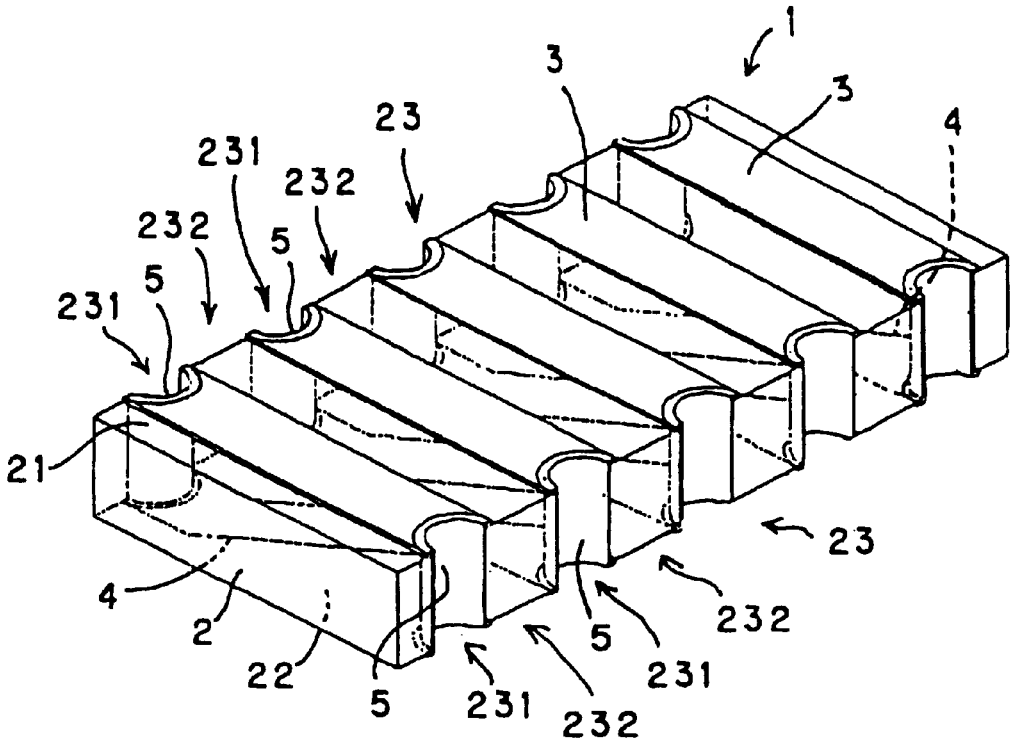
FIG. 6 shows a perspective view of the antenna device according to a second example of the present invention.

FIG. 6 shows a perspective view of the antenna device according to the second example of the present invention.

The substrate 2 of this antenna device 1 includes an upper face 21, a lower face 22 and a pair of side faces 23 on which concave portions 231 and convex portions 232 are alternately formed as in the substrate 2 of the antenna device 1 shown in FIG. 1. However, the conductor layer of the antenna device 1 shown in FIG. 6 is a little different from the conductor layer of the antenna device shown in FIG. 1. In the antenna device 1 shown in FIG. 6, the conductor layer 3 for connecting a pair of the concave portions 231 is formed on the upper face 21, the conductor layer 4 to connect one concave portion to the other concave portion shifted by one pitch is formed on the back face 22, and the conductor layer 5 is formed on an inner wall face of the concave portion, thereby forming a helical conductor layer with the conductor layers 3, 4 and 5. The conductor layers 3, 4 and 5 also serve as a helical conductor layer for surrounding the substrate 2 as a whole, as in the antenna device shown in FIG. 1.

The preferable substrate 2 of the antenna device 1 shown in FIG. 6 also has a stable specific dielectric constant ($\in r$) or a stable specific magnetic permeability ($\mu r$) with a low loss and a small temperature coefficient ($\tau r$) of the resonance frequency, as in the antenna device shown in FIG. 1. An alumina based ceramic ($\in r$=8.5, Q=1000 and $\tau r$=38 ppm/° C. at 2 GHz) was used in this embodiment. The preferable conductor includes a low resistance conductor such as copper, silver and gold. A silver-platinum paste (QS-171 made by Dupont CO.) was used in this example.

Figure 7:
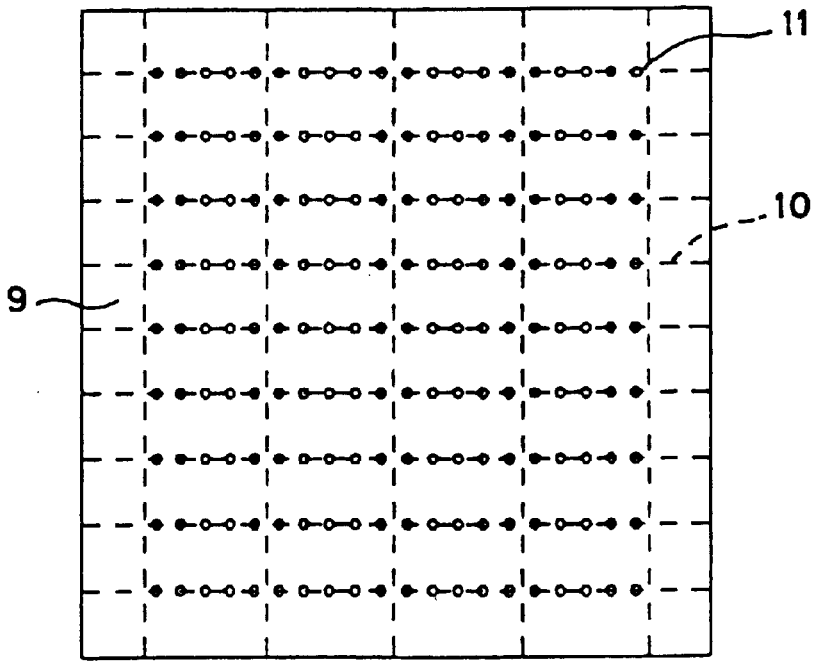
FIG. 7 shows an intermediate step of the manufacturing process of the antenna device shown in FIG. 2.

The method for manufacturing the antenna device shown in FIG. 6 will now be described with reference to FIGS. 7 to 10. Snap lines 10 are provided on the alumina substrate 9 as shown in FIG. 7 so as to be able to divide the substrate into a desired size in subsequent steps, and through holes 11 are provided at desired sites on the snap lines 10. The snap lines 10 are separated by a distance of 5 mm along the vertical direction and by a distance of 10 mm apart along the transverse direction. The through holes 11 have a diameter of 0.8 mm and are separated by a distance of 2 mm on the snap lines 10 along the transverse direction on the alumina substrate 9. The alumina substrate 9 has a width of 50 mm, a length of 50 mm and a thickness of 1 mm.

Figure 8:
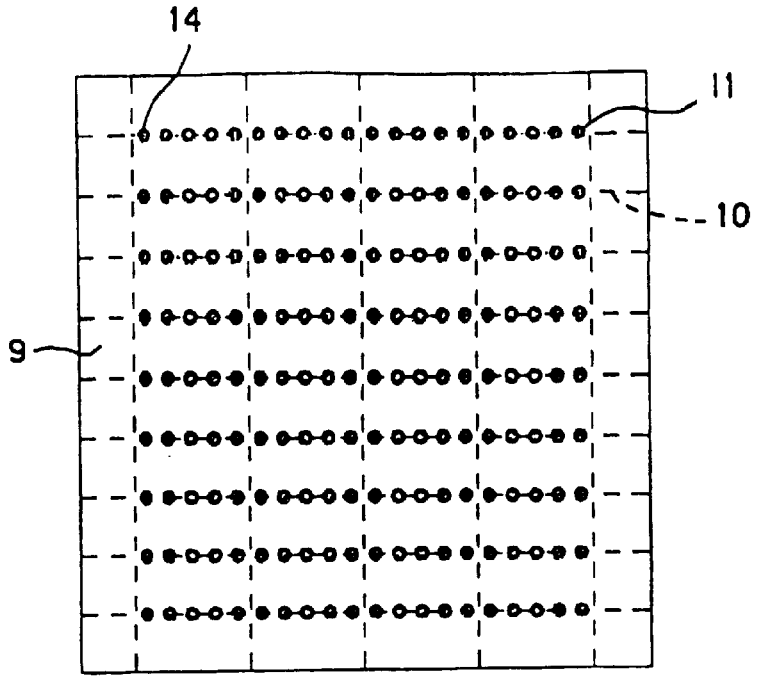
FIG. 8 shows another intermediate step of the manufacturing process of the antenna device shown in FIG. 2.
Figure 9:
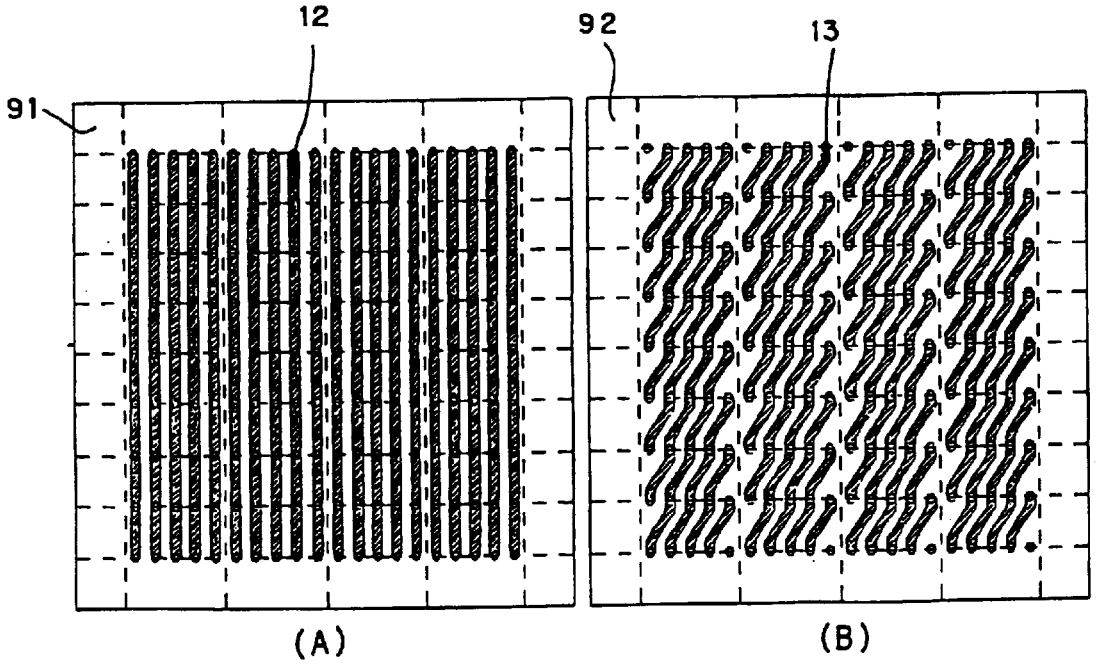
FIG. 9A shows yet another intermediate step of the manufacturing process of the antenna device shown in FIG. 2.
FIG. 9B shows still another intermediate step of the manufacturing process of the antenna device shown in FIG. 2.

After filling the conductor paste into the through holes on the alumina substrate 9 by printing as shown in FIG. 8, the paste was fired at 850° C. after drying to complete through hole conductors 14.

Subsequently, conductor patterns 12 and 13 are formed by printing as shown in FIG. 9A and FIG. 9B, respectively, on the upper face 91 and lower face 92 of the alumina substrate 9.

Figure 10:
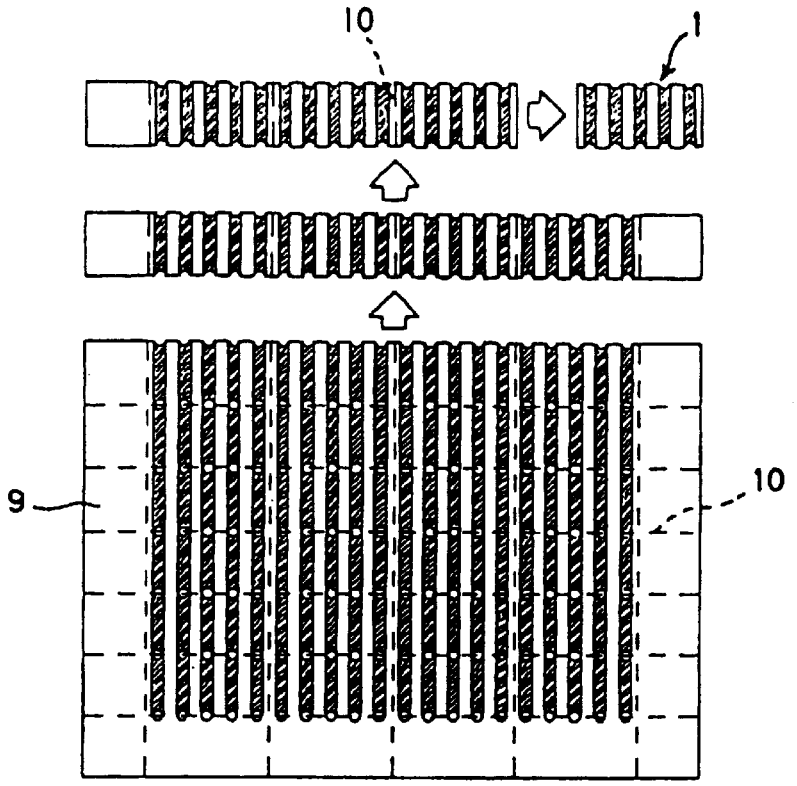
FIG. 10 shows another intermediate step of the manufacturing process of the antenna device shown in FIG. 2.

The antenna device 1 is finally obtained by dividing the substrate into minimum units along the snap lines 10 as shown in FIG. 10. Several antennae having such construction as described above can be manufactured at the same time to reduce costs.

While two examples have been described herein, a layer having the same quality as the alumina substrate 9 may be formed on the conductor layer on the alumina substrate before or after dividing the alumina substrate 9 in either of these examples, thereby allowing an antenna for use in a same transmission and reception band to be more compacted.

Figure 11:
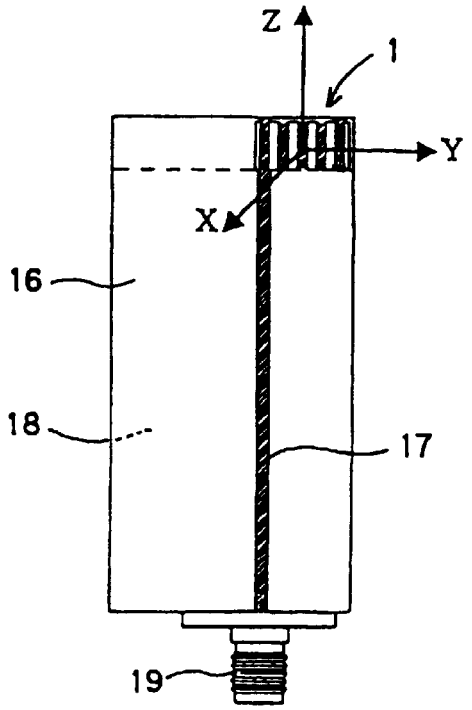
FIG. 11 illustrates a method for evaluating the antenna device.

The performance of the antenna device shown in FIG. 6 and manufactured as described above will now be described. The antenna device 1 was mounted on a evaluation substrate with a length of 25 mm, a width of 50 mm and a thickness of 0.8 mm as shown in FIG. 11. A strip line 17 and a ground face 18 were formed on the surface and back face of the insulation substrate 16 in this evaluation substrate. Electricity was supplied from a SMA connector 19 at one end to the antenna device 1 via the strip line 17.

Figure 12:
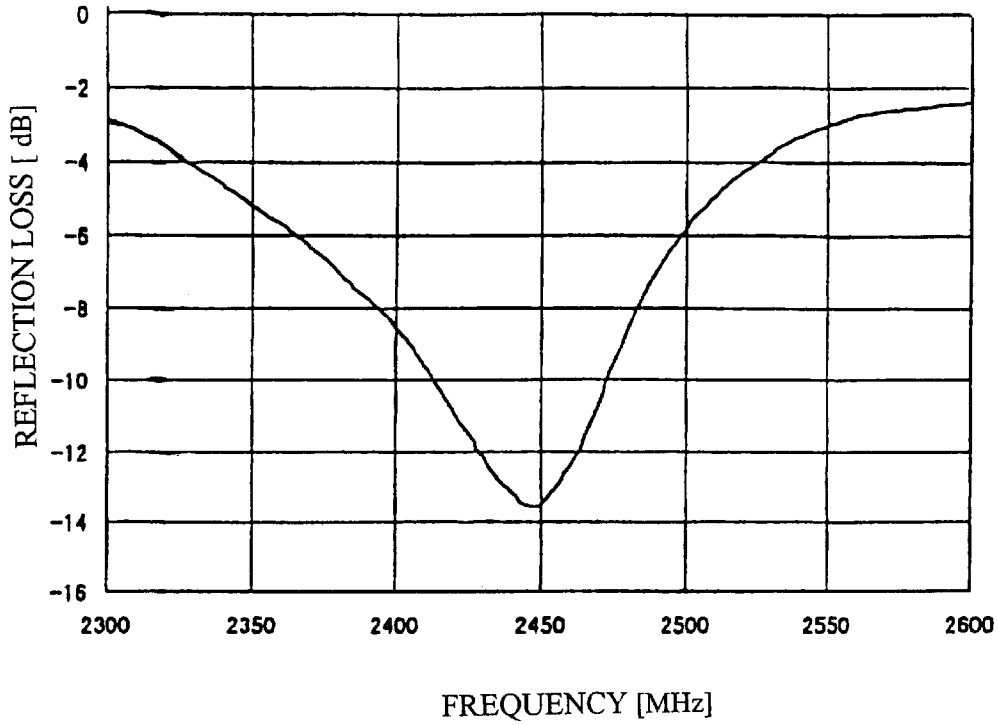
FIG. 12 is a graph showing the relationship between the reflection loss and frequency characteristics of the antenna device.

The relationship between the reflection loss and frequency characteristics is shown in FIG. 12. The resonance frequency was 2448 MHZ and the reflection loss was −6 dM or below at a band width of 133 MHz.

Figure 13:
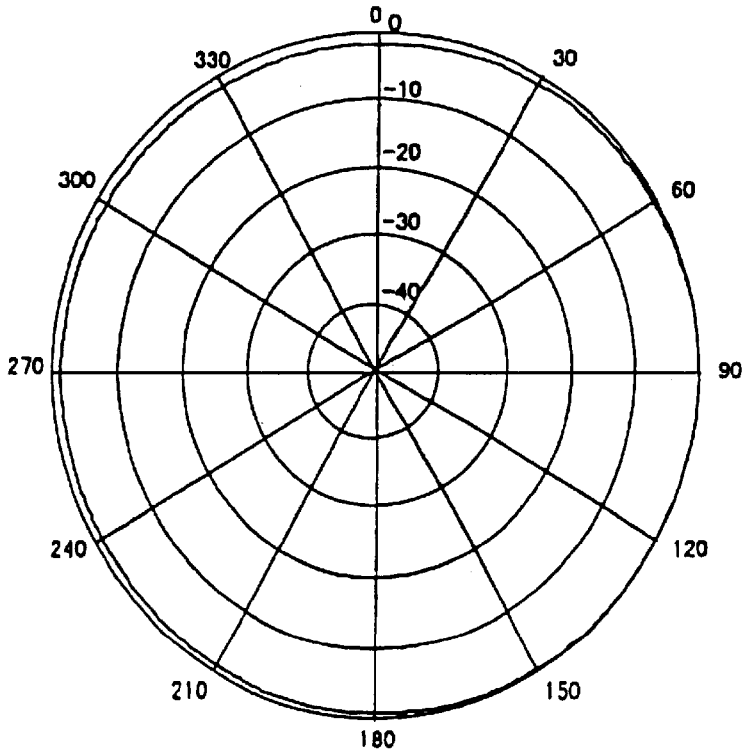
FIG. 13 shows an emission pattern on the XY-plane in FIG. 11.

The radiation pattern on the XY plane in FIG. 11 is shown in FIG. 13. Radiation gain turned out to be approximately omnidirectional in this face, while the maximum gain was −0.7 dBi and the minimum gain was −2.3 dBi.

While the antenna device having the construction as shown in FIG. 6 has been evaluated, the result was almost identical to the evaluation result of the antenna device having the construction as shown in FIG. 1. Accordingly, explanations thereof will be omitted.

Figure 14:
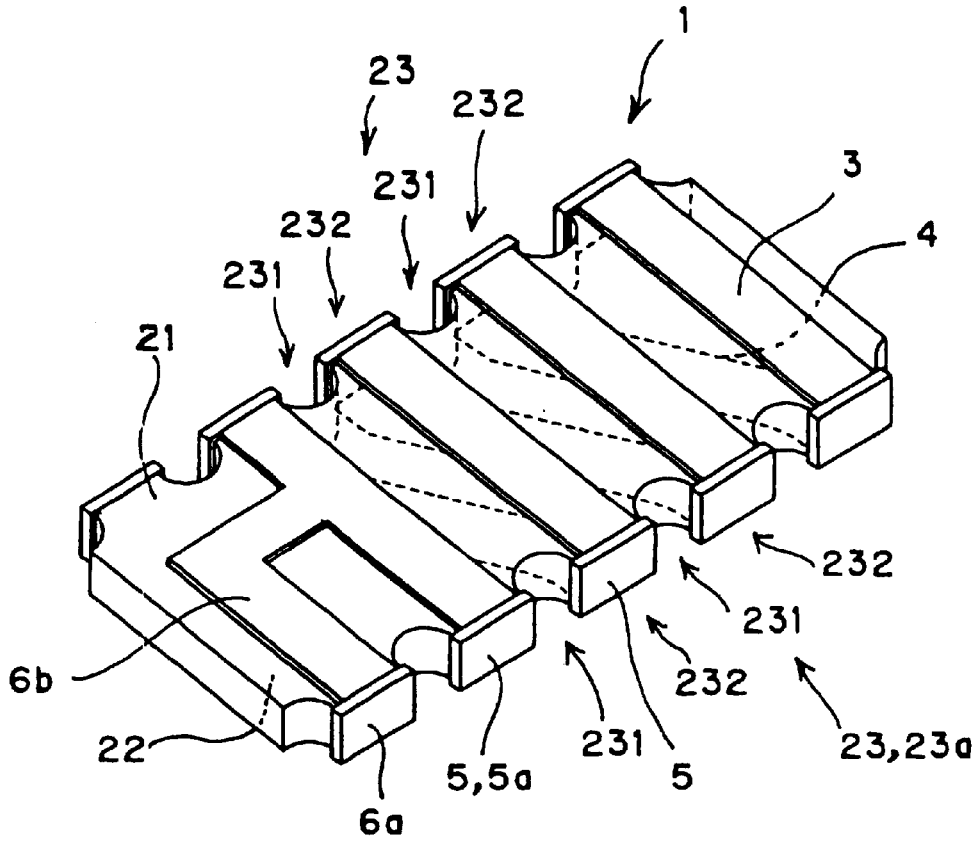
FIG. 14 shows a perspective view of the antenna device according to a third example of the present invention.

FIG. 14 shows a perspective view of the antenna device according to the third example of the present invention.

The substrate 2 of the antenna device 1 includes an upper face 21 and a lower face 22, and a pair of side faces 23 on which concave portions 231 and convex portions 232 are alternately formed. Conductor layers 3 for connecting corresponding convex portions 232 on opposite side faces 23 are formed on the upper face 21 of the substrate 2. Conductor layers 4 for connecting one convex portion 232 to the other convex portion on the opposite side face shifted by one pitch are formed on the lower face 22 of the substrate 2. Conductor layers 5 are also formed on the concave portions 232 on side faces 23. The conductor layers 3, 4 and 5 serve as a helical conductor layer spirally surrounding the substrate 2 as a whole.

A conductor layer at a farthest end of the conductor layers 5 spirally surrounding the substrate on a side face 23*a* serves as a power feed electrode 5*a*. A ground electrode 6*a* is formed at an adjoining position to the power feed electrode 5*a* with a given distance apart from the helical conductor layer. A connection conductor 6*b* connecting the helical conductor layer to the ground electrode 6*a* via the upper face 21 of the substrate is additionally formed.

It is preferable the substrate 2 has a stable specific dielectric constant ($\in r$) or a stable specific magnetic permeability ($\mu r$) with a low loss and a small temperature coefficient ($\tau r$) of the resonance frequency. An alumina based ceramic ($\in r$=8.5, Q=1000 and $\tau r$=38 ppm/° C. at 2 GHz) was used in this example. The preferable conductor includes a low resistance conductor such as copper, silver and gold. A silver-platinum paste (QS-171 made by Dupont CO.) was used in this example.

Figure 15:
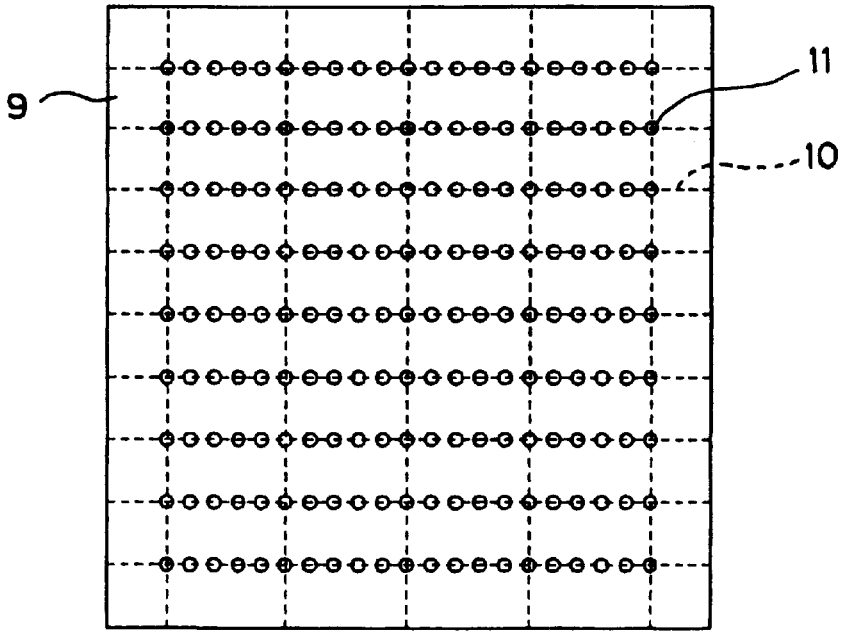
FIG. 15 shows an intermediate step of the manufacturing process of the antenna device shown in FIG. 14.

The method for manufacturing the antenna device 1 will now be described with reference to FIGS. 15 to 19. First, an alumina substrate 9 as shown in FIG. 15 is prepared. Snap lines 10 are provided on the alumina substrate 9 so it can be divided into a desired size in subsequent steps. Through holes 11 are also provided on the desired sites on the snap lines 10. The snap lines 10 are separated by a distance of 5 mm along the vertical direction and by a distance of 10 mm along the transverse direction. The through holes 11 have a diameter of 0.8 mm and are separated by a distance of 2 mm on the snap lines 10 along the vertical direction on the alumina substrate 9. The alumina substrate 9 has a width of 50 mm, a length of 50 mm and a thickness of 1 mm.

Figure 16:
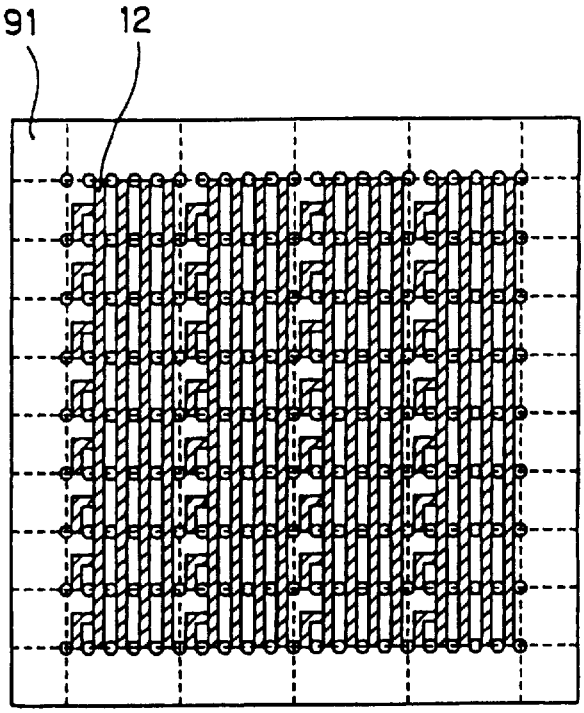
FIG. 16 shows another intermediate step of the manufacturing process of the antenna device shown in FIG. 14.
Figure 17:
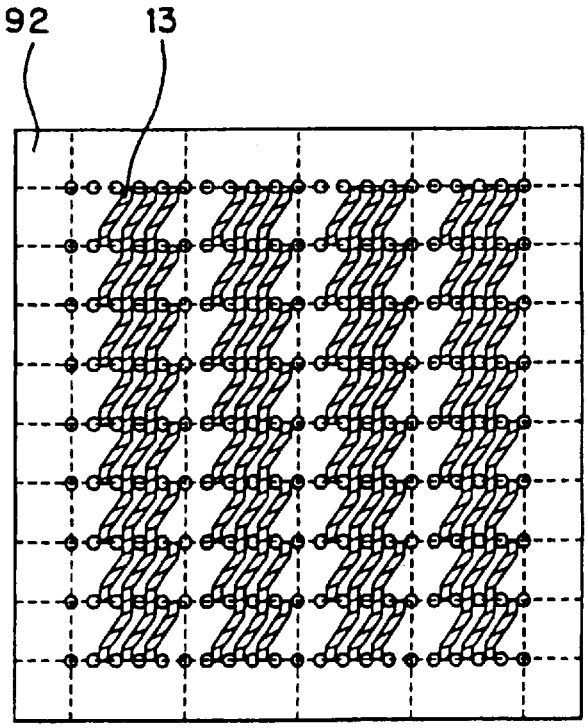
FIG. 17 shows yet another intermediate step of the manufacturing process of the antenna device shown in FIG. 14.

Conductor patterns 12 and 13 are then formed on the upper face 91 and lower face 92, respectively, on the alumina substrate 9 as shown in FIGS. 16 and 17. A conductor paste was screen-printed to form the conductor patterns, followed by firing at 850 ° C. after drying.

Figure 18:
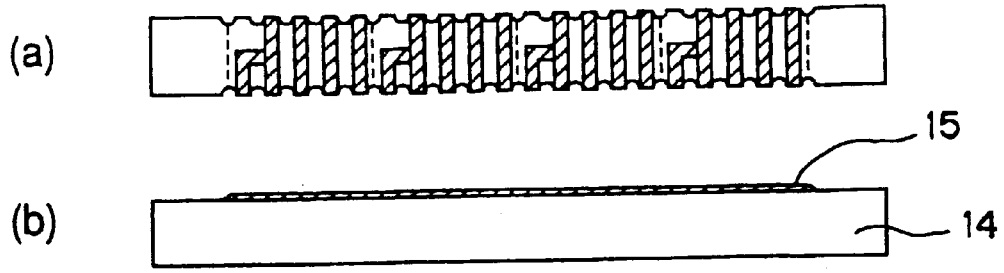
FIG. 18A shows still another intermediate step of the manufacturing process of the antenna device shown in FIG. 14.
FIG. 18B shows another intermediate step of the manufacturing process of the antenna device shown in FIG. 14.
Figure 19:
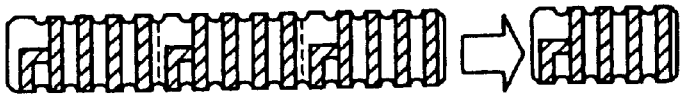
FIG. 19 shows yet another intermediate step of the manufacturing process of the antenna device shown in FIG. 14.

Then, the substrate 9 is divided along the snap lines on which through holes had been formed as shown in FIG. 18. Convex portions formed on the alumina substrate by the through holes are then dipped into a conductor paste 15 previously spread to a thickness of about 0.2 mm on a flat plate 14, such as a glass plate using a squeezer to coat only the tips of the convex portions with the conductor paste 15. The resultant structure is then dried and fired.

An antenna device 1 is finally obtained by dividing the substrate into minimum units along the snap lines. Several antennas having a construction as described above can be manufactured at the same time to reduce costs.

Figure 20:
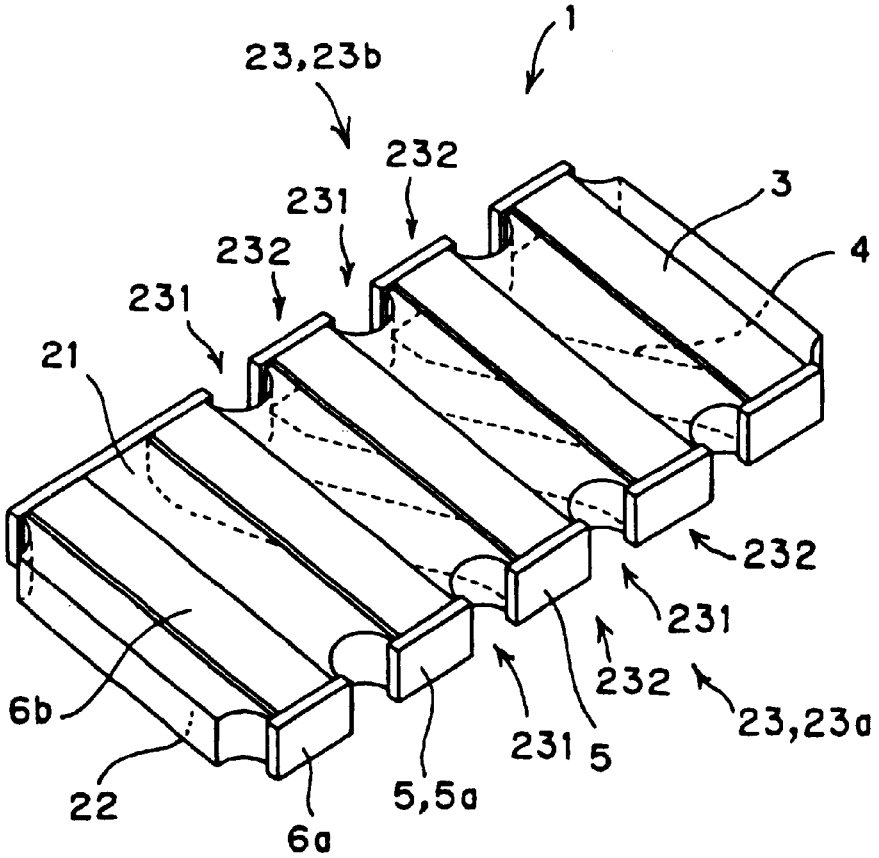
FIG. 20 shows a perspective view of the antenna device according to a fourth example of the present invention.

FIG. 20 shows a perspective view of the antenna device according to the fourth example of the present invention. The difference of this example from the third example shown in FIG. 14 will now be described. While the ground electrode 6*a* is connected to the conductor layer spirally surrounding the substrate as a whole via the connection conductor 6*b* on the upper face 21 of the substrate in the third example shown in FIG. 14, the ground electrode 6*a* is connected to the conductor layer via the connection conductor 6*b* on the opposed side face 23*b* on which the ground electrode 6*a* is formed in the fourth example shown in FIG. 20.

Figure 21:
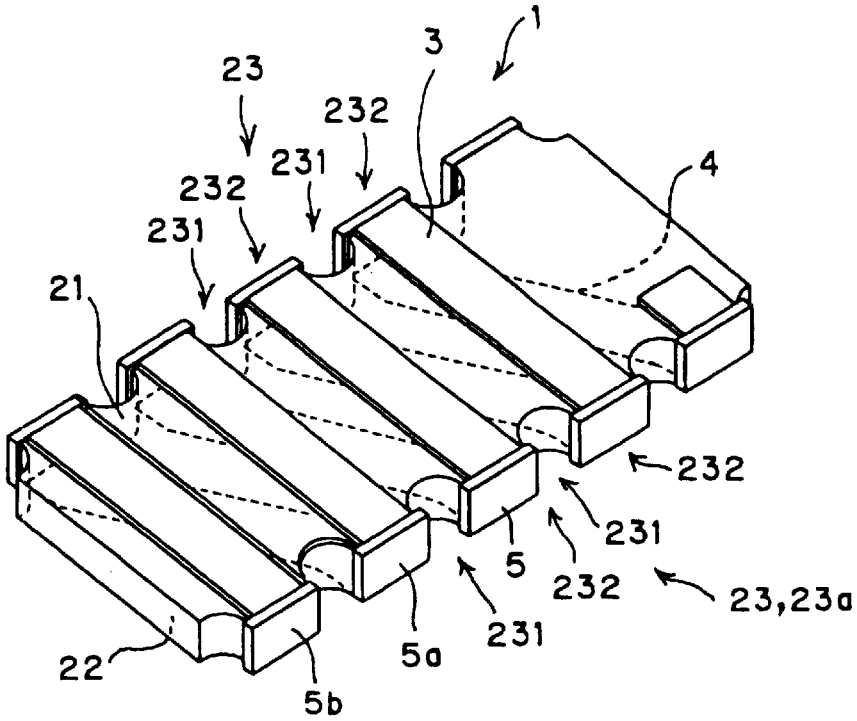
FIG. 21 shows a perspective view of the antenna device according to a fifth example of the present invention.

FIG. 21 shows a perspective view of an antenna device according to the fifth example of the present invention. In the fifth example, a conductor layer at the farthest end of the conductor layers 5 on one side face 23*a* serves as a ground electrode 5*b*, which also serves as a ground conductor, and the conductor layer adjoining to the ground electrode serves as a power feed electrode 5*a*.

Figure 22:
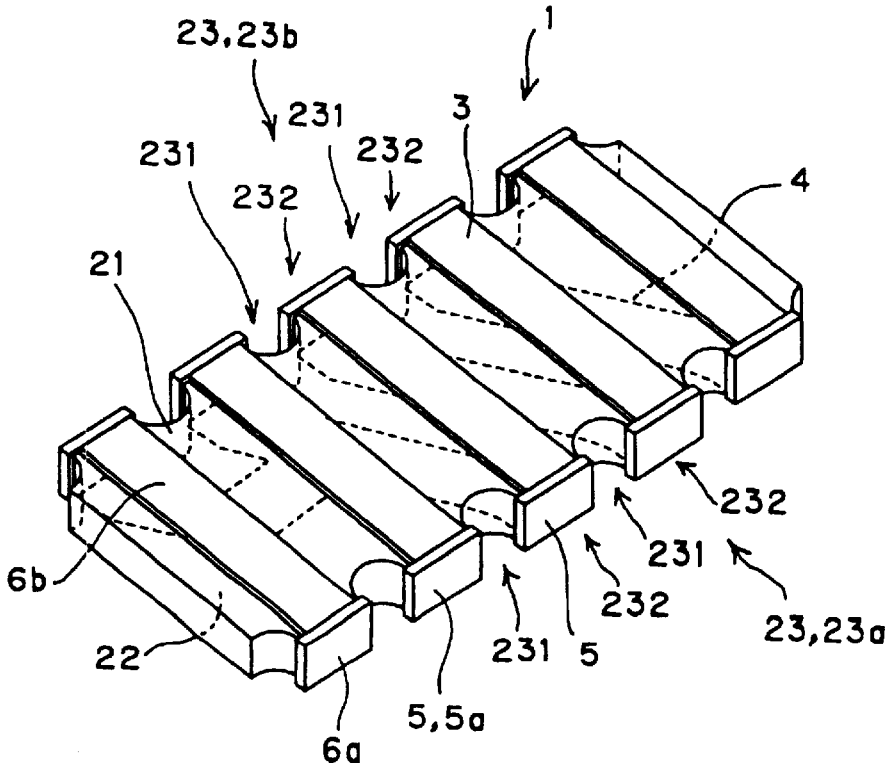
FIG. 22 shows a perspective view of another antenna device.

FIG. 22 shows a perspective view on an another example of the antenna device. While the antenna device shown in FIG. 22 is provided as a comparative example of the antenna device according to the present invention, it also serves as an antenna device for constituting an assembly of the antenna device according to the present invention to be described hereinafter.

In the antenna device shown in FIG. 22, the ground electrode 6*a* is connected to the helical conductor layer surrounding the substrate as a whole with a connection conductor 6*b*, via the upper face 21 of the substrate, via the side face 23*b* at the opposite side to the side face 23*a* on which the ground electrode 6*a* is formed, and via the lower face of the substrate.

The performance of the antenna device manufactured as described above will now be described.

Figure 23:
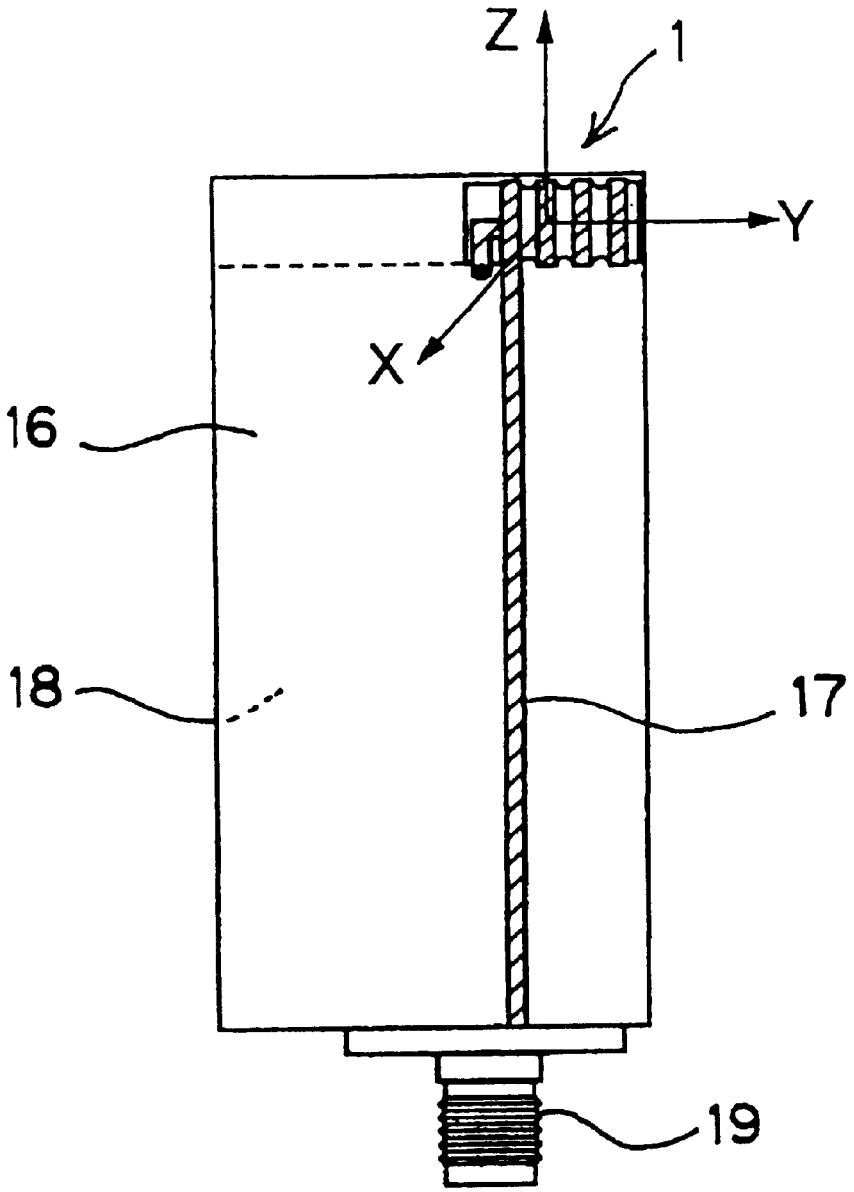
FIG. 23 illustrates a method for evaluating the antenna device.

The antenna device 1 was mounted on an evaluation substrate with a width of 50 mm, a length of 25 mm and a thickness of 0.8 mm as shown in FIG. 23. A strip line 17 is formed on the surface, and a ground face 18 is formed on the back face of the insulation substrate 16. Electricity is supplied from a SAM connector 19 through the strip line 17 to the antenna device 1 mounted on the other end of the substrate.

TABLE 1 shows the results measured of the antenna device 1 described above. The "3σ value of dispersion" denotes the 3σ value of dispersion of the resonance frequencies when a number of the antenna devices having the same specification are manufactured.

TABLE 1

DISPERSION OF RESONANCE FREQUENCY FROM CENTRAL FREQUENCY 2.45 GHz

| CONTACT POSITION | 3σ VALUE OF DISPERSION |
|---|---|
| EXAMPLE 1: UPPER FACE OF ANTENNA (FIG. 14) | ±30 MHZ |
| EXAMPLE 2: SIDE FACE (FIG. 20) | ±60 MHZ |
| EXAMPLE 3: TERMINAL ALSO SERVES AS CONTACT POSITION (FIG. 21) | ±62 MHZ |
| COMPARATIVE EXAMPLE: LOWER FACE (FIG. 22) | ±155 MHZ |

TABLE 1 shows that the distribution is suppressed in Examples 1 to 3 as compared with the comparative Example.

Figure 24:
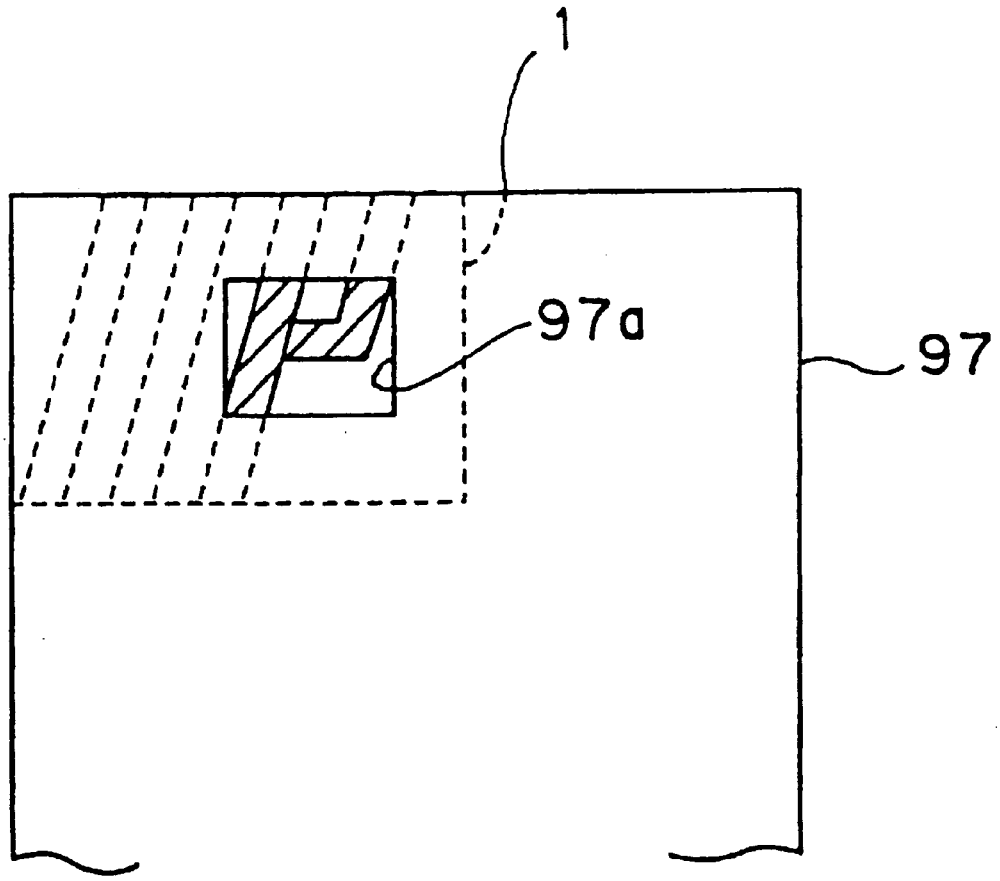
FIG. 24 shows an assembly of the antenna device according to the first example of the present invention.

FIG. 24 shows an assembly of the antenna device according to the first example of the present invention. In more detail, FIG. 24 shows a circuit board 97 viewed from the bottom face on which the antenna device 1 is mounted so that the lower face of the antenna device contacts the upper face of the substrate.

The ground electrode shown in FIG. 22 is connected to the helical conductor layer via the connection conductor layer on the lower face of the substrate in this type of the antenna device 1. A hole 96*a* piercing from the upper face to the lower face is provided on the circuit board 97 by chipping a part of the circuit board. The contact point between the connection conductor layer and the helical conductor layer on the lower face of the substrate of the antenna device 1 is just located on the hole 96*a* to avoid the connection part from contacting to the circuit board 97.

Figure 25:
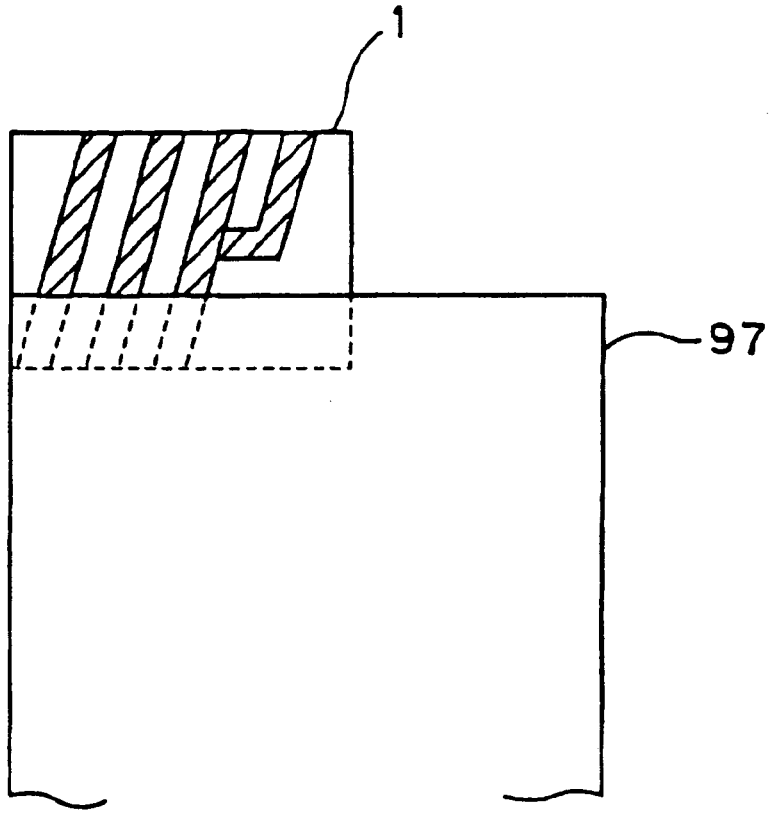
FIG. 25 shows an assembly of the antenna device according to the second example of the present invention.
Figure 26:
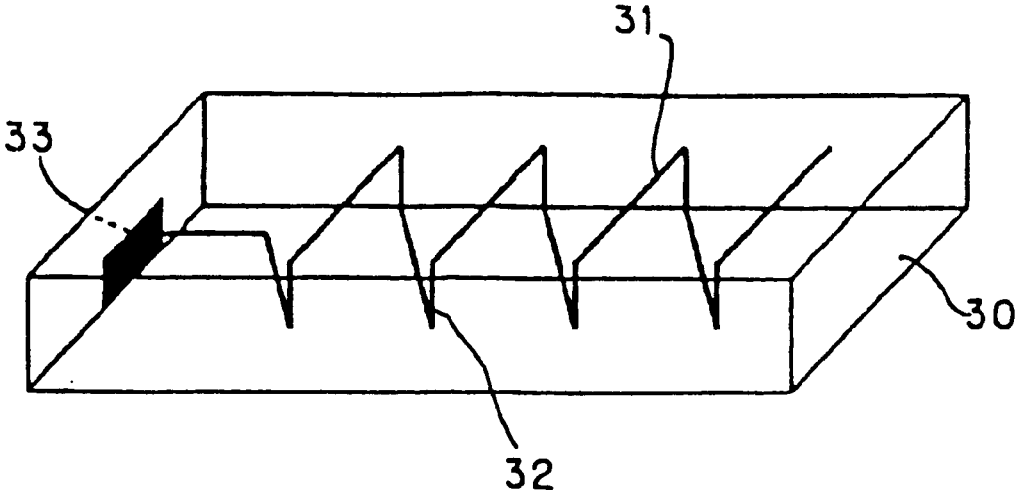
FIG. 26 illustrates a conventional compact antenna capable of surface packaging on a circuit board.

FIG. 25 shows an another assembly of the antenna device according to the second embodiment of the present invention. In more detail, FIG. 25 also shows a circuit board 97 viewed from the bottom face on which the antenna device 1 of the type shown in FIG. 22 is mounted so that the lower face of the antenna device contact the upper face of the substrate as in FIG. 22.

Although no chipped portion is provided on the circuit board 97, the contact portion between the connection conductor and the helical conductor of the antenna device 1 is made to protrude from the circuit board 97.

Dispersion of the resonance frequencies can be suppressed by mounting the antenna device so a part of the circuit board is chipped or the contact portion is allowed to protrude from the circuit board, even when the contact portion is formed on the lower face of the antenna device. TABLE 2 shows measurement results of the dispersion of resonance frequencies of the assembly of the antenna device in the embodiments shown in FIGS. 24 and 25.

TABLE 2

DISPERSION OF RESONANCE FREQUENCY FROM CENTRAL FREQUENCY 2.45 GHz

| MOUNTING METHOD | 3σ VALUE OF DISPERSION |
|---|---|
| CHIPPING OF SUBSTRATE UNDER CONTACT POINT (FIG. 24) | ±72 MHz |
| PROTRUSION OF ANTENNA (FIG. 25) | ±68 MHz |

TABLE 2 shows the dispersions of frequencies in this table are smaller as compared with the dispersion in the lowermost row in TABLE 1.

The foregoing results indicate the antenna device and the assembly of the antenna device have sufficient performances as an antenna for the portable communication set.

According to the present invention as described above, a surface packaging type antenna that is ready for mass-production and most suitable for the portable communication terminals can be provided by forming conductors on the convex or concave portions provided on the side face of the substrate, and by connecting the conductors formed on the upper and lower faces to form a helical emission member in the helical antenna in which the helical emission member is formed on the surface of the dielectric substrate.

Also, according to the present invention, dispersion of resonance frequencies can be suppressed to be smaller in the antenna device in which the helical emission member is formed on the surface of the dielectric substrate by forming the contact point between the helical conductor and the grounding linear conductor at the portion where the contact point does not make contact with the circuit board when the antenna device is mounted on the circuit board, as compared with dispersion of frequencies of the antenna device in which the contact point is formed on the surface to serve as a circuit substrate.

Obviously, numerous modifications and variations of the present invention are possible in light of the above teachings. It is therefore to be understood that within the scope of the appended claims, the invention may be practiced otherwise than as specifically described herein.

What is claimed is:

1. An antenna device, comprising:

a substrate having upper and lower faces, and a pair of side faces on which convex portions and concave portions are alternately formed; and a helical conductor layer on the upper and lower faces, and on one of the concave portions and convex portions so as to spirally surround the entire substrate, wherein the convex portions and concave portions including the helical conductor layer are sequentially disposed with a predetermined distance on side faces of the substrate, wherein one of the convex portions and concave portions including the helical conductor layer, and wherein another one of the convex portions and concave portions including the helical conductor layer comprises an earth electrode configured to ground the helical conductor layer.

2. The antenna device according to claim 1, wherein the substrate comprises at least one of a dielectric material and a magnetic material.

3. The antenna device according to claim 1, further comprising:

a layer covering at least a part of the helical conductor layer on the substrate.

4. The antenna device according to claim 3, wherein the layer comprises at least one of a dielectric material and a magnetic material.

5. The antenna device according to claim 1, wherein one of the convex portions and the concave portions including the helical conductor layer located at a farthest end thereof comprises the power feed electrode configured to feed electricity to the helical conductor layer, wherein the earth electrode configured to ground the helical conductor layer is disposed on one of the convex portions and concave portions including the helical conductor layer adjacent to the power feed electrode on a same side face of the substrate on which the power feed electrode is formed, and wherein a connection conductor layer configured to connect the earth electrode to the power electrode is disposed on the upper face of the substrate.

6. The antenna device according to claim 5, wherein the connection conductor layer is disposed on the upper face of the substrate and a side face opposed to the side face on which the earth electrode is formed.

7. The antenna device according to claim 1, wherein the power feed electrode feeds electricity to the helical conductor layer and the earth electrode grounds the helical conductor layer without requiring a loading capacitor electrode.

8. A method of making an antenna device, comprising:

alternately forming convex and concave portions on side faces of a substrate;

forming a helical conductor layer on upper and lower faces of the substrate, and on one of the concave portions and convex portions so as to spirally surround the entire substrate;

sequentially disposing one of the convex portions and concave portions including the helical conductor layer with a predetermined distance on the side faces of the substrate;

configuring one of the convex portions and concave portions including the helical conductor layer to be a power feed electrode for feeding electricity to the helical conductor layer; and configuring another one of the convex portions and concave portions including the helical conductor layer to be an earth electrode for grounding the helical conductor layer.

9. The method according to claim 8, wherein the substrate comprises at least one of a dielectric material and a magnetic material.

10. The method according to claim 8, further comprising:

covering at least one of the helical conductor layer on the substrate with a covering layer.

11. The method according to claim 10, wherein the covering layer comprises at least one of a dilectric material and a magnetic material.

12. The method according to claim 8, further comprising:

configuring one of the convex portions and the concave portions including the helical conductor layer located at a farthest end thereof to be the power feed electrode for feeding electricity to the helical conductor layer;

forming the earth electrode for grounding the helical conductor layer on one end of the convex portions and concave portions including the helical conductor layer adjacent to the power feed electrode on a same side face of the substrate on which the power feed electrode os formed; and forming a connection conductor layer for connecting the earth electrode to the power electrode on the upper face of the substrate.

13. The method according to claim 12, wherein the connection conductor layer is disposed on the upper face of the substrate and a side face opposed to the side face on which the earth electrode is formed.

14. The method according to claim 8, wherein the power feed electrode feeds electricity to the helical conductor layer and the earth electrode grounds the helical conductor layer without requiring a loading capacitor electrode.

15. An antenna device, comprising:

alternating convex and concave portions on side faces of a substrate; and helical conductor means on upper and lower faces of the substrate, and on one of the concave portions and convex portions for spirally surround the entire substrate, wherein the covex portions and concave portions including the helical conductor means are sequentially disposed with a predetermined distance on side faces of the substrate, wherein one of the convex portions and concave portions including the helical conductor means comprises power feed electrode means for feeding electricity to the helical conductor means, and wherein another one of the convex portions and concave portions including the helical conductor means comprises earth electrode means for grounding the helical conductor means.

16. The antenna device according to claim 15, wherein the substrate comprises at least one of a dielectric material and a magnetic material.

17. The antenna device according to claim 15, further comprising:

means for covering at least a part of the helical conductor layer on the substrate.

18. The antenna device according to claim 17, wherein the covering means comprises at least one of a dielectric material and a magnetic material.

19. The antenna device according to claim 15, wherein one of the convex portions and the concave portions including the helical conductor means located at a farthest end thereof comprises the power feed electrode means for feeding electricity to the helical conductor layer.

20. The antenna device according to claim 19, wherein the connection conductor means is disposed on the upper face of the substrate and a side face opposed to the side face on which the earth electrode means is formed.

21. The antenna device according to claim 15, wherein the power feed electrode means feeds electricity to the helical conductor means and the earth electrode means grounds the helical conductor means without requiring a loading capacitor electrode.

* * * * *